US007014134B2

(12) United States Patent
Heinzelmann et al.

(10) Patent No.: US 7,014,134 B2
(45) Date of Patent: Mar. 21, 2006

(54) STIRRED BALL MILL

(75) Inventors: Martin Heinzelmann, Frenkendorf (CH); Stefan Spornberger, Riehen (CH)

(73) Assignee: Willy A. Bachofen AG, Basel (CH)

( * ) Notice: Subject to any disclaimer, the term of this patent is extended or adjusted under 35 U.S.C. 154(b) by 87 days.

(21) Appl. No.: 10/823,131

(22) Filed: Apr. 13, 2004

(65) Prior Publication Data

US 2005/0224612 A1 Oct. 13, 2005

(30) Foreign Application Priority Data

Apr. 15, 2003 (CH) ..... 0678/03

(51) Int. Cl.
*B02C 17/16* (2006.01)

(52) U.S. Cl. ..... 241/171; 241/172

(58) Field of Classification Search ..... 241/171, 241/172, 165, 175

See application file for complete search history.

(56) References Cited

U.S. PATENT DOCUMENTS

| | | | | |
|---|---|---|---|---|
| 3,814,334 A | * | 6/1974 | Funk | 241/70 |
| 4,117,981 A | * | 10/1978 | Engels | 241/46.15 |
| 5,630,557 A | | 5/1997 | Barthelmess | |
| 5,797,550 A | | 8/1998 | Woodall et al. | |
| 5,984,213 A | * | 11/1999 | Woodall et al. | 241/21 |
| 6,021,969 A | * | 2/2000 | Schmitt et al. | 241/171 |

FOREIGN PATENT DOCUMENTS

| | | |
|---|---|---|
| DE | 195 10 807 A1 | 9/1995 |
| EP | 0 771 591 A1 | 5/1997 |

* cited by examiner

*Primary Examiner*—Mark Rosenbaum
(74) *Attorney, Agent, or Firm*—Michael J. Striker

(57) ABSTRACT

The horizontally operating stirred ball mill has a cylindrical grinding chamber (50) serving for receiving grinding media, a material inlet (37) arranged at the end of the grinding chamber (50) and opening into the interior (3) of the grinding chamber (50), a material outlet (38) arranged at the other end of the grinding chamber and leading out of the interior (3), a stirrer (1) having a plurality of stirrer members (2) and coaxial with the chamber axis (60), and a separation system present upstream of the material outlet (38) and consisting of a separation member (80) and a drive member which drives said separation member and which separates the grinding media from the ground material and transports them back into the interior (3) of the grinding chamber (50). The separation member (80) has two circular disks (5, 7) which are arranged coaxially with the chamber axis (61) and between which a plurality of conveying or blade elements (12) symmetrically distributed around the midpoint of the disk and leading inwards from the disk edge are arranged, which elements, during operation of the stirred ball mill, generate an opposing pressure on the mixture of material and grinding media, so that, owing to the centrifugal force and the different specific density, the grinding media are separated from the product and are transported back into the interior (3).

7 Claims, 2 Drawing Sheets

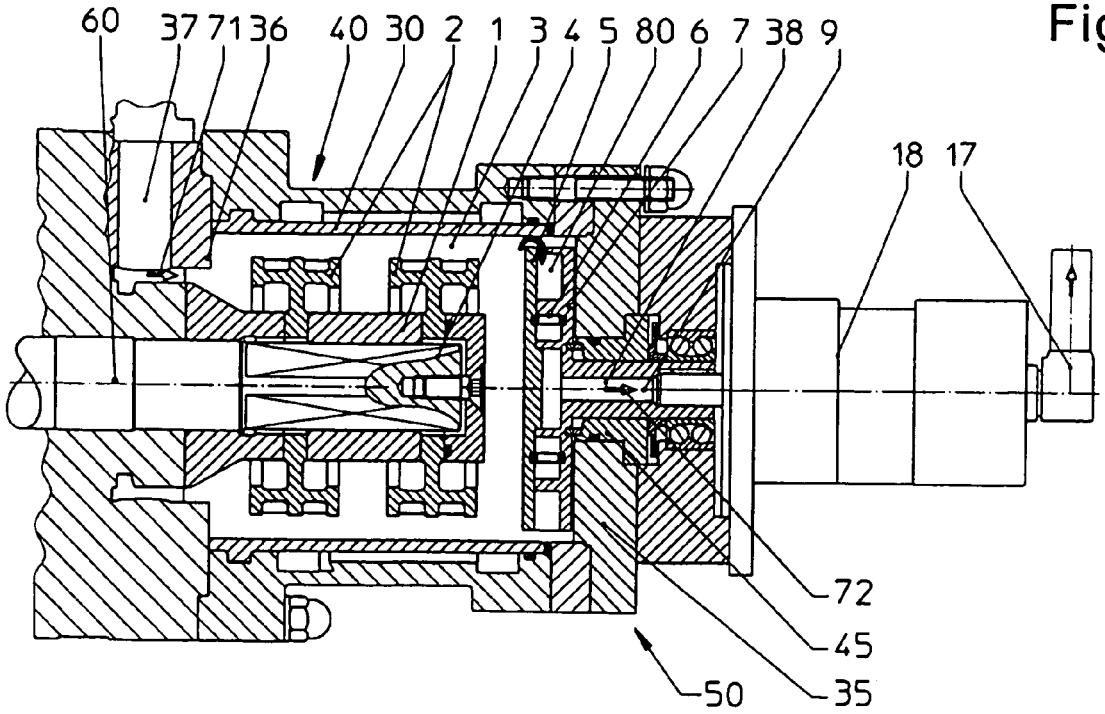
Fig.1
Fig. 2a
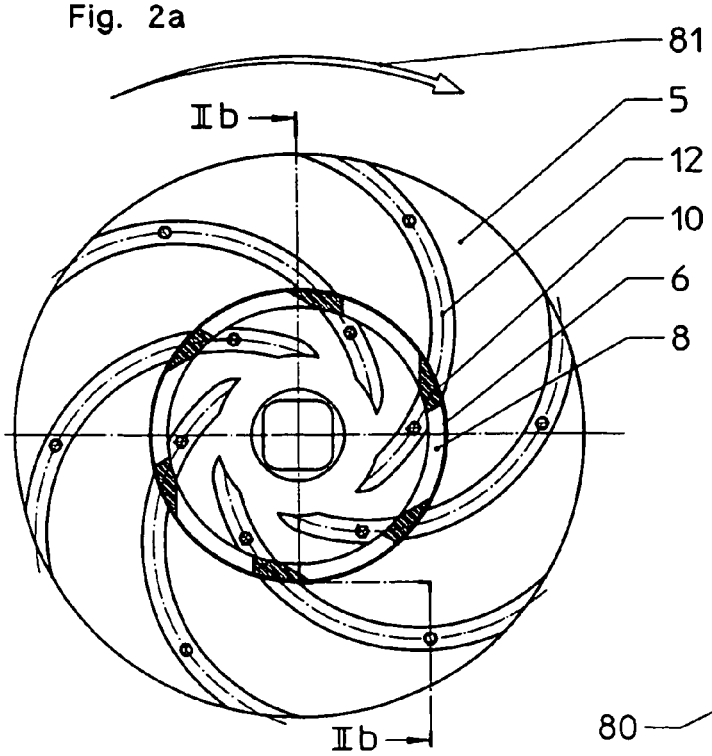
Fig. 2b
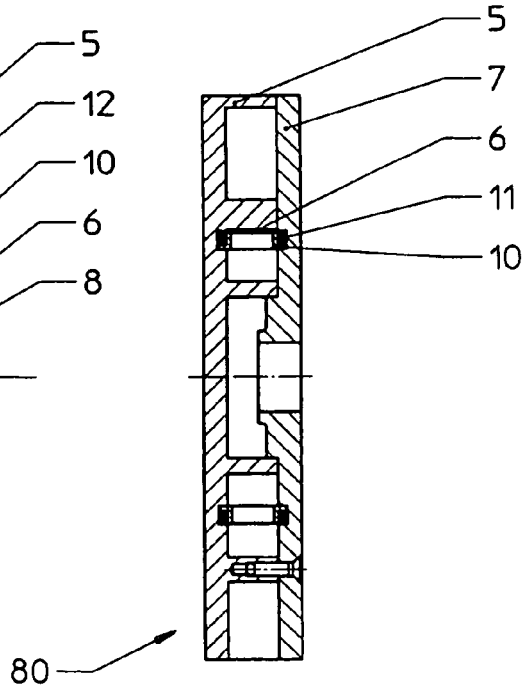

STIRRED BALL MILL

BACKGROUND OF THE INVENTION

1. Field of the Invention

The invention relates to a stirred ball mill having a separation member for separating very small grinding media having a diameter D≦0.1 mm from the product.

Stirred ball mills are used, for example, for comminuting and dispersing solids in a liquid phase or for digesting microorganisms.

2. Description of the Prior Art

Stirred ball mills known on the market and intended for continuous operation have a cylindrical grinding chamber with a horizontal or vertical axis and have various types of separation members for separating the grinding media from the product in the product outlet region.

The housing of the grinding chamber of a stirred ball mill consists of a longitudinal wall and two end walls arranged at the two ends of the longitudinal wall. It has a material inlet which serves for feeding the material to be ground and a material outlet which serves for removing the material. Moreover, a stirrer rotatable about the chamber axis is arranged in the grinding chamber for transporting the grinding media present in the mill radially relative to the stirrer shaft and thus comminuting or dispersing, by means of impact and shear forces, the material passed continuously through the grinding chamber.

During the continuous flow through a stirred ball mill, an entraining force which acts on the grinding media occurs independently of the flow velocity and of the viscosity of the suspension of material to be ground. Consequently, the grinding media are entrained with the material to be ground from the entrance into the grinding zone up to the separation membrane in the region of the material outlet. This may lead to compression of the grinding media before the separation member, which compression is associated with increased wear and increased risk of blockage. In the case of very small grinding media having a diameter D≦0.1 mm, the entrainment effect of the product increases several-fold and is critical in the case of very fine milling and dispersing, particularly in the case of high throughput rates.

Stirred ball mills are known which, for solving this problem, have various constructions such that the entrained grinding media are permitted to circulate in the mill with recycling into the grinding zone. However, the known solutions are very often inadequate for grinding media of D≦0.1 mm.

In further known separation systems, such as, for example, with the use of so-called split-sieve cartridges, the production with small gap widths of ≦0.05 mm proves to be very difficult, which gap widths are moreover scarcely usable in practice. In addition, the probability that the sieve will be blocked is very high in these cases if grinding media having D≦0.1 mm have to be used, which is necessary in nanotechnology and hence also in the production of nanoparticles.

A further problem arises through the high pressure drop owing to the accumulation of grinding media on the sieve. In the so-called friction-gap version, extremely high precision is required in production in order to ensure the small friction gaps of ≦0.05 mm in the entire course of production.

The Offenlegungschrift DE 44 12 408 A1 discloses partly keeping the grinding media away from the outlet member in a horizontal mill by means of a preclassification disk and a rotating cage, but grinding media can be entrained through the bores close to the axis in the separation means through which the product has to flow, and said grinding media can thus reach the outlet member. Since the entrainment effect of the material to be ground increases with decreasing diameter of the grinding media, the use of a corresponding separation apparatus which effectively and reliably separates the grinding media from the product is therefore indispensable for such applications.

A blockage of the outlet, possibly caused by the narrow tolerances at the material outlet, can lead to a marked pressure increase and suppress the actual grinding and dispersing process. On failure of the separation function, grinding media moreover emerge from the mill and the grinding and dispersing process deteriorates to an increasing extent. Moreover, in this case, the ground material is contaminated with grinding media.

Further proposals for avoiding the blockage of the separation means are described mainly for vertical stirred ball mills. Such an invention is described in Patent EP 0 771 591 A1. This is a vertical stirred ball mill in which the material to be milled flows upwards through a grinding container loaded with grinding media and a separator resting on the stirrer member before the outflow. Since the separator has no sieve, filter or other system for retaining grinding media, this invention cannot be used in the case of a mill having a horizontal axis since, on filling with grinding media or on emptying the ground material after the end of the milling process, emergence of grinding media at the outlet is to be expected, which contaminates the ground material with grinding media. Furthermore, the centrifugal acceleration of the grinding media is dependent on the velocity of the stirrer disks and hence also on the property of the product which, for example in the case of products sensitive to shearing and hence low speeds, may lead to an excessively low centrifugal acceleration of the grinding media or to the emergence of the grinding media. Vertical stirred ball mills also have the disadvantage of inhomogeneous distribution of grinding media in the grinding chamber, which leads to a poor grinding or dispersing performance.

SUMMARY OF THE INVENTION

It is the object of the invention to provide a stirred ball mill having a horizontal axis and a novel separation member which does not have the above-mentioned disadvantages and by means of which a material can be milled in a gentle manner and uniformly using very small grinding media which have a diameter D≦0.1 mm, without these leaving the grinding space.

This object is achieved by a stirred ball mill having the features of Claim 1.

Advantageous embodiments of the invention are the subject of the dependent Claims.

BRIEF DESCRIPTION OF THE DRAWINGS

Below, embodiments of the invention are described with reference to the drawings. In the drawings, FIG. 1 shows a longitudinal section through a part of a horizontal grinding chamber having a separation member of the type according to the invention, FIG. 2*a* shows a cross-section through the separation member shown in FIG. 1, FIG. 2*b* shows a section along the line IIb of FIG. 2*a*.

DESCRIPTION OF THE PREFERRED EMBODIMENTS

Figure 3:
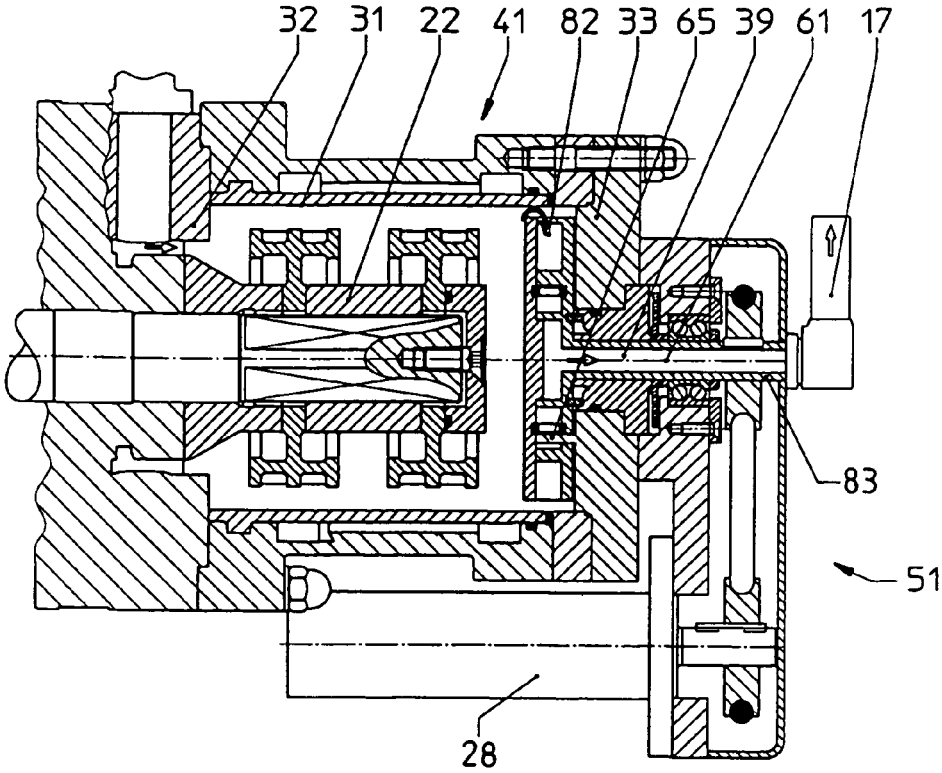
FIG. 3 shows a longitudinal section through a second embodiment of the invention.

The grinding chamber of a stirred ball mill is shown only partly in FIG. 1, is denoted as a whole by 50 and has a housing 40 with a horizontal axis 60. The housing 40 has an elongated, substantially cylindrical longitudinal wall 30 and two end walls 35 and 36 which are arranged at both ends of the longitudinal wall 30 and of which the end wall 36 has a material inlet 37 which serves for feeding the material to be milled and the end wall 35 has a material outlet 38 which serves for removing the material.

A stirrer 1 which has a plurality of paddle wheel-like stirrer members 2, for example two thereof, distributed along the axis 60, is arranged in the interior 3. The shaft 4 of the stirrer 1 is coaxial with the axis 60 and is connected, at its end passing through the end wall 36, to a drive apparatus not shown in the drawing.

Present in the end wall 35 of the grinding chamber 50 is a separation member 80 which is arranged coaxially with the axis 60 and is connected to an external drive 18. This external drive 18 causes the separation member 80 to execute rotational movements independent of the stirrer 1. The outlet 38 for ground material leads coaxially with the axis 60 from the separation member 80 to the rotary passage 17.

Provided in the end wall 35 is a seal 45 which ensures that no ground material together with grinding media passes through the annular gap between separation apparatus 80 and end wall 35 to the outside. This seal 45 corresponds to the requirements for the grinding media size ≦0.1 mm.

As is evident from FIGS. 1, 2*a* and 2*b*, the separation member 80 has a circular disk 5 resting on the shaft 9 and detachably fastened thereto, and a circular disk 7 facing the end wall 35 and having a tubular material outflow 38 which is arranged coaxially with the axis 60, projects into the end wall 35 and ends in the rotary passage 17.

The two disks 5 and 7 of the separation member 80 which are arranged parallel to one another are a predetermined distance apart. This is determined by a plurality of conveying or blade elements 12 which are distributed symmetrically around the midpoint of the disk, lead inwards from the disk edge and are arc-shaped in plan view. In the preferred embodiment according to FIGS. 2*a*, 2*b*, the circular disk 7 rests on the blade elements 12 and is detachably or nondetachably connected via these to the disk 5.

Furthermore, an annular cage 10 having a sieve plate ring 6 present on its outer surface can be placed in a circular cavity 8 between the disks 5 and 7. The annular cage 10 is preferably pressed and sealed with O-rings 11 and can optionally be mounted with or without sieve plate ring 6. The choice of the use of the sieve plate ring 6 can be adapted to the respective product properties.

During operation of a stirred ball mill having the grinding chamber 50, a material which is to be ground or to be dispersed in a liquid is passed continuously in fluid form through the inlet 37 in the direction of the arrow 71 into the interior 3 of the grinding chamber 50 and is transported therein to the outlet 38 for ground material. This may comprise, for example, of chiefly products from nanotechnology, but also dye suspension, surface coatings, printing inks, agrochemicals, filler suspension, video tape coating material, cosmetics, food, pharmaceuticals or microorganisms. During the operation of the stirred ball mill, the grinding media present in the interior 3 of the grinding chamber 50 grind and/or disperse the material passed continuously through the grinding chamber 50, whereupon the product produced in the grinding chamber leaves said grinding chamber—in a continuous fluid stream—through the separation organ 80 in the direction of the arrow 72. The use of very small grinding media of D≦0.1 mm serves mainly for breaking up the agglomerates and aggregates without destroying the primary particles thereby.

The separation member 80 driven by the drive 18 and rotating in the direction of the arrow 81 (FIG. 2*a*) is formed and dimensioned in such a way that the mixture formed from the grinding media and the ground and/or dispersed material flows into the intermediate space between the two disks 5 and 7, whereupon, owing to the centrifugal force and the different specific density, the grinding media serving for grinding are separated from the ground material by the conveying elements 12 and are transported back into the interior 3 of the grinding chamber 50. The ground material itself passes through the circular cavity 8 of the separation member 80 to the material outflow 38, where it leaves the grinding chamber 50. Owing to the rotation of the separation member 80, the product has to overcome a relative pressure on flowing through the separation member against the centrifugal force. This pressure, which is between 0.5 and 3 bar, depending on the operating state, is applied by the feed pump, which is not shown. In correspondence with this load, the housing of the separation member 80 and also the seal 45 on the drive shaft 9 must be designed to be pressure-resistant; in most cases, the use of a double axial face seal is required for the latter.

In order to separate grinding media, the determining operating parameters are the peripheral velocity of the separation member 80 and the radial flow velocity in the flow channels. The peripheral velocity is determined by the rotational speed. The radial flow velocity results from the free cross-section and the volume flow rate of the product through the pump.

The grinding chamber 51 shown in FIG. 3 substantially corresponds to the grinding chamber according to FIG. 1. In other words, the separation member denoted here by 82 is present opposite the stirrer 22 on a separate drive shaft, and the outlet 39 for ground material leads coaxially with the axis 61 from the separation member 82 to the rotational passage 17. In this case, the drive 28 is arranged parallel to the axis 61 and, via a gear step-down/step-up, causes the shaft carrying the separation member 83 to execute a rotational movement independent of the stirrer 22. A sieve scraper 65 is additionally provided in this variant, which sieve scraper serves for scraping off any grinding media adhering to the sieve 6, so that no disadvantageous pressure increase takes place and all grinding media can be recycled by the rotational movement of the separation member 82 to the grinding chamber.

Figure 4:
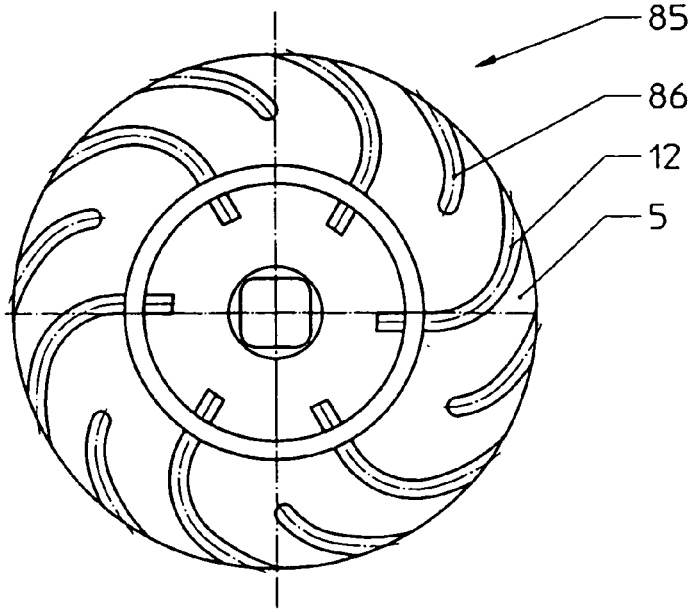
FIG. 4 shows a plan view of an alternative embodiment of a separation member of the type according to the invention.

The paddle wheel-like separation member 85 shown as a view in FIG. 4 differs from the separation members 80 and 82 described above in that straight or slightly curved conveying elements 86 which extend inwards from the disk edge are additionally provided between the arc-shaped blade elements 12. Consequently, a secondary flow develops in the interior.

It should be pointed out here that, in the case of a rotation of the separation member which is opposite to the direction of rotation of the stirrer shaft, the conveying elements are of course formed or arranged as a mirror image of the elements 12 and 86 shown in FIGS. 2 and 4, respectively.

The separation system, according to the invention, of a stirred ball mill for very small grinding media having a diameter D≦0.1 mm has the following advantages over the known separation systems:

- The rotation of the very small grinding media in the grinding space is ensured by the controlled setting of the speed of the separation member, which setting is independent of the stirrer shaft speed.
- The problems in the production of the components have been reduced.
- The blockage problems at the split sieve and sieve plate have been reduced by the use of simple thin fabrics or have been eliminated by omitting the sieves.
- The loading of the separation parts is unimportant.
- Wear at the friction gap is nonexistent.
- The production problems of a very narrow and accurate friction gap construction have been eliminated.

It should be pointed out here that the grinding chambers, stirrer members and separation members described with reference to FIGS. 1 to 3 represent only a selection of a plurality of possible embodiments of the invention and can be modified in various respects.

Thus, for example, the separation members 80 and 82 can optionally be provided with or without straight conveying elements 86, the conveying elements 12 and 86 can be fastened either on the disks 5 or 7, and the separation member can optionally be equipped with or without sieve plate ring 6. Furthermore, the construction sizes of the separation members are dependent on the peripheral velocities to be chosen and may vary greatly from case to case.

Furthermore, the stirrer members described above may be combined in any numbers with one another and/or also with other known stirrer members, and the grinding chamber may additionally be formed with pressure relief valves or the like, in order to compensate any pressure variations, in particular pressure increases. Finally, the longitudinal wall of the grinding chamber may additionally be surrounded by a cylindrical casing which, together with it, bounds an intermediate space which is circular in cross-section and into which a cooling or heating fluid can be passed for cooling or heating the material present in the interior.

What is claimed is:

1. A continuously operating horizontal stirred ball mill serving for fine and very fine grinding of a material and having a cylindrical or conical grinding chamber (50, 51) serving for receiving grinding media, a material inlet (37) arranged at the end of the grinding chamber (50, 51) and opening into the interior (3) of the grinding chamber (50, 51), a material outlet (38, 39) arranged at the other end of the grinding chamber and leading out of the interior (3), and a stirrer (1, 22) having a plurality of stirrer members (2) and coaxial with the chamber axis (60), and a separately driven separation system which is arranged upstream of the material outlet (38, 39) and which separates the grinding media from the ground material and transports them back into the interior (3) of the grinding chamber (50, 51), wherein the separation system is formed from a separation member (80, 82) which has two circular disks (5, 7) which are arranged coaxially with the chamber axis (61) and between which is arranged a plurality of conveying or blade elements (12, 86) which are symmetrically distributed around the midpoint of the disk, lead inwards away from the disk edge and, during operation of the separation apparatus, generate an opposing pressure on the mixture of material and grinding media, so that, owing to the centrifugal force and the different specific density, the grinding media are separated from the product and transported back into the interior (3).

2. The stirred ball mill as claimed in claim 1, wherein the conveying or blade elements are arc-shaped.

3. The stirred ball mill as claimed in claim 2, wherein straight or approximately straight conveying or blade elements (86) which extend inwards from the disk edge are also provided in addition to the arc-shaped conveying or blade elements (12).

4. The stirred ball mill as claimed in claim 1, wherein the two circular disks (5, 7) are detachably or nondetachably connected to one another.

5. The stirred ball mill as claimed in claim 1 or 2, wherein a concomitantly rotating annular cage (10) which encloses a circular cavity (8) is provided between the two circular disks (5, 7).

6. The stirred ball mill as claimed in claim 5, wherein a sieve plate ring (6) is placed in the annular cage (10).

7. The stirred ball mill as claimed in claim 6, wherein a sieve scraper (65) which serves for scraping off any grinding media and ground material adhering to the sieve or for keeping said grinding media and said ground material in motion is provided on the end wall (35).

* * * * *